US005572489A

United States Patent [19]

Born et al.

[11] Patent Number: 5,572,489

[45] Date of Patent: Nov. 5, 1996

[54] TIMEPIECE WITH ROTATABLE OUTER RING

[75] Inventors: Jean-Jacques Born, Morges; Etienne Bornand, Boudry; Gérard Jaeger, Blonay; René Viennet, Neuchâtel, all of Switzerland

[73] Assignee: Asulab S.A., Bienne, Switzerland

[21] Appl. No.: 628,350

[22] Filed: Apr. 5, 1996

[30] Foreign Application Priority Data

Apr. 19, 1995 [CH] Switzerland ..... 01116/95
Dec. 13, 1995 [CH] Switzerland ..... 03533/95

[51] Int. Cl.[6] ..... G04B 19/22

[52] U.S. Cl. ..... 368/21; 368/27

[58] Field of Search ..... 368/21–27, 76, 368/80, 185–187

[56] References Cited

U.S. PATENT DOCUMENTS

| | | | |
|---|---|---|---|
| 3,513,653 | 5/1970 | Denardo | 368/27 |
| 4,109,457 | 8/1978 | Laesser et al. | 368/27 |
| 4,347,594 | 8/1982 | Tschanz | 368/21 |
| 4,451,159 | 5/1984 | Tanaka . | |

FOREIGN PATENT DOCUMENTS

| | | |
|---|---|---|
| 2166059 | 8/1973 | France . |
| 608323 | 1/1979 | Switzerland . |
| 613088 | 9/1979 | Switzerland . |

*Primary Examiner*—Vit W. Miska
*Attorney, Agent, or Firm*—Sughrue, Mion, Zinn, Macpeak & Seas

[57] ABSTRACT

A universal timepiece (10) having a manually operable outer ring (33) for selecting one of twenty-four time zones, where a display indicates the time of the time zone selected. For this purpose a device for detecting the rotational position of the outer ring (33) is provided which has a special arrangement of permanent magnets (39*a–j*) in the outer ring (33) and of magnetic switches (27*a–h*) in the timepiece casing (11, 12) in a specific number as well as evaluating electronics in the timepiece movement (21). The permanent magnets (39*a–j*) determine the binary statuses of the magnetic switches (27*a–h*), which are interpreted together as a signal or as a status pattern. The special arrangement of the magnetic switches (27*a–h*) and the permanent magnets (39*a–j*) effect for each rotational position an intrinsic status pattern different in each case from the others which permits a clear indication of the selected rotational position of the outer ring (33).

10 Claims, 4 Drawing Sheets

Fig. 4

Figure 1:
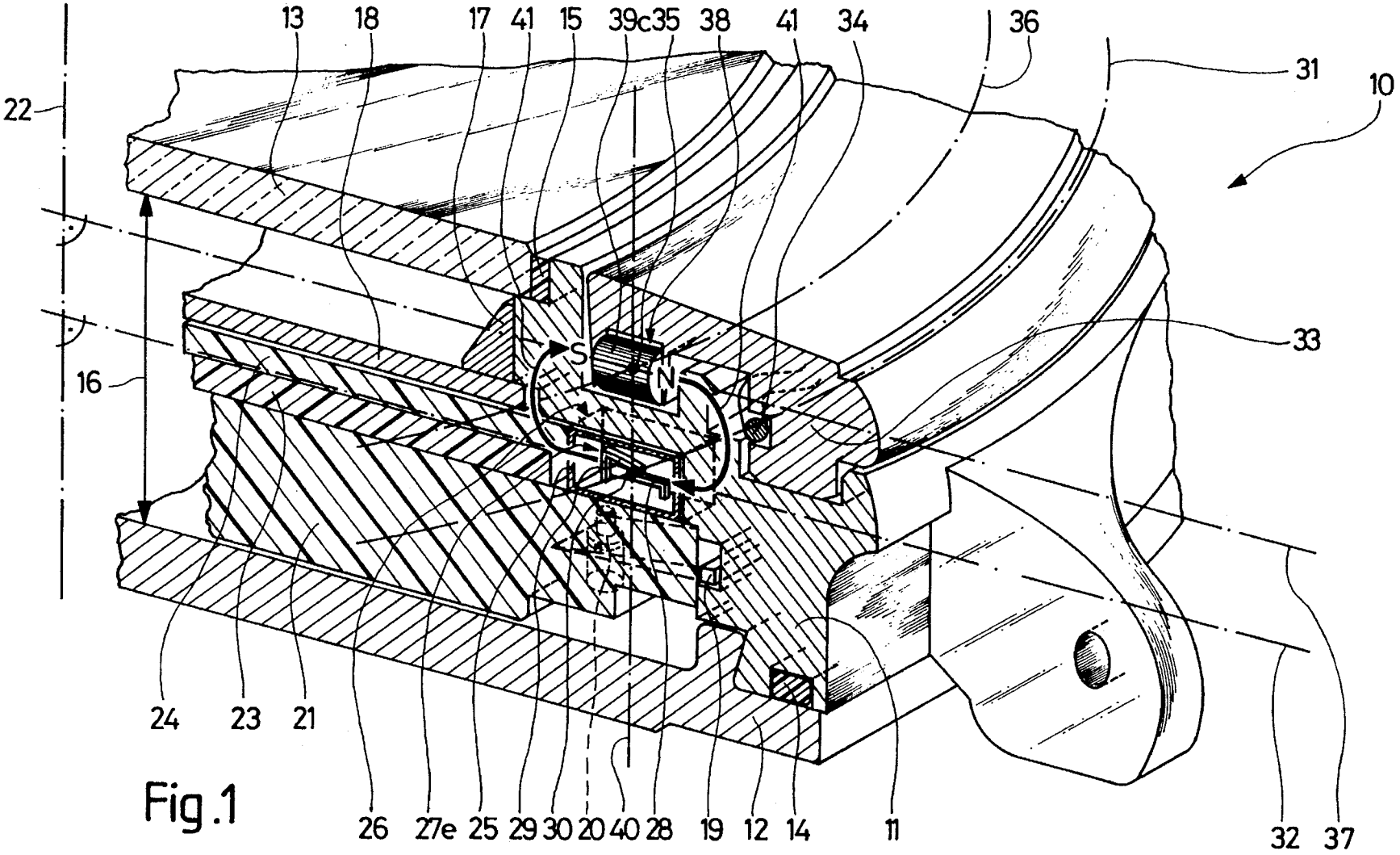

| | 27a | 27b | 27c | 27d | 27e | 27f | 27g | 27h |
|---|---|---|---|---|---|---|---|---|
| 0° | 0 | 0 | 0 | 0 | 1 | 0 | 0 | 1 |
| 15° | 0 | 1 | 0 | 1 | 0 | 0 | 0 | 0 |
| 30° | 0 | 0 | 0 | 0 | 0 | 0 | 1 | 0 |
| 45° | 1 | 0 | 0 | 0 | 0 | 1 | 0 | 0 |
| 60° | 0 | 0 | 1 | 0 | 1 | 0 | 0 | 0 |
| 75° | 0 | 0 | 0 | 0 | 0 | 0 | 0 | 1 |
| 90° | 0 | 1 | 0 | 0 | 0 | 0 | 1 | 0 |
| 105° | 0 | 0 | 0 | 1 | 0 | 1 | 0 | 0 |
| 120° | 1 | 0 | 0 | 0 | 0 | 0 | 0 | 0 |
| 135° | 0 | 0 | 1 | 0 | 0 | 0 | 0 | 1 |
| 150° | 0 | 0 | 0 | 0 | 1 | 0 | 1 | 0 |
| 165° | 0 | 1 | 0 | 0 | 0 | 0 | 0 | 0 |
| 180° | 1 | 0 | 0 | 1 | 0 | 0 | 0 | 0 |
| 195° | 0 | 0 | 0 | 0 | 0 | 1 | 0 | 1 |
| 210° | 0 | 0 | 1 | 0 | 0 | 0 | 0 | 0 |
| 225° | 0 | 1 | 0 | 0 | 1 | 0 | 0 | 0 |
| 240° | 1 | 0 | 0 | 0 | 0 | 0 | 1 | 0 |
| 255° | 0 | 0 | 0 | 1 | 0 | 0 | 0 | 0 |
| 270° | 0 | 0 | 1 | 0 | 0 | 1 | 0 | 0 |
| 285° | 0 | 1 | 0 | 0 | 0 | 0 | 0 | 1 |
| 300° | 0 | 0 | 0 | 0 | 1 | 0 | 0 | 0 |
| 315° | 0 | 0 | 0 | 1 | 0 | 0 | 1 | 0 |
| 330° | 1 | 0 | 1 | 0 | 0 | 0 | 0 | 0 |
| 345° | 0 | 0 | 0 | 0 | 0 | 1 | 0 | 0 |

Fig.5

| | 27a | 27b | 27c | 27d | 27e |
|---|---|---|---|---|---|
| 0° | 0 | 1 | 0 | 1 | 0 |
| 15° | 0 | 0 | 1 | 0 | 1 |
| 30° | 1 | 0 | 0 | 1 | 0 |
| 45° | 0 | 1 | 0 | 0 | 1 |
| 60° | 0 | 0 | 1 | 0 | 0 |
| 75° | 0 | 0 | 0 | 1 | 0 |
| 90° | 0 | 0 | 0 | 0 | 1 |
| 105° | 0 | 0 | 0 | 0 | 0 |
| 120° | 1 | 0 | 0 | 0 | 0 |
| 135° | 1 | 1 | 0 | 0 | 0 |
| 150° | 1 | 1 | 1 | 0 | 0 |
| 165° | 0 | 1 | 1 | 1 | 0 |
| 180° | 0 | 0 | 1 | 1 | 1 |
| 195° | 1 | 0 | 0 | 1 | 1 |
| 210° | 1 | 1 | 0 | 0 | 1 |
| 225° | 0 | 1 | 1 | 0 | 0 |
| 240° | 1 | 0 | 1 | 1 | 0 |
| 255° | 1 | 1 | 0 | 1 | 1 |
| 270° | 0 | 1 | 1 | 0 | 1 |
| 285° | 0 | 0 | 1 | 1 | 0 |
| 300° | 0 | 0 | 0 | 1 | 1 |
| 315° | 1 | 0 | 0 | 0 | 1 |
| 330° | 0 | 1 | 0 | 0 | 0 |
| 345° | 1 | 0 | 1 | 0 | 0 |

TIMEPIECE WITH ROTATABLE OUTER RING

The invention relates to a universal timepiece according to the classifying part of claim 1.

A universal timepiece disclosed in U.S. Pat. No. 4,451,159 has a rotatable outer ring which permits the manual selection of a plurality of available functions. For this purpose, the underside of the ring has a specific arrangement of concave and convex areas which cooperate with switches disposed in the casing of the timepiece. For each defined rotational position of the outer ring the statuses of the switches in each case form a specific status pattern which is evaluated by an electronic circuit. This specification shows solutions for examples with up to twelve rotational positions. If the teaching described therein is expanded to, for example twenty-four rotational positions, this gives rise to a number of switches that does not correspond to the minimal possible. This solution consequently does not, satisfactorily meet the need for the lowest possible number of switch elements and thus a cost reduction. A further disadvantage is the fact that, to make direct contact with the concave and convex areas of the outer ring, the switches have to pass through the timepiece casing and therefore need additional seals which can in time become permeable because of dirt deposits and wear and tear.

In EP 198 576, the rotational position of the outer ring is also determined using switches disposed in the casing of the timepiece. The underside of the outer ring is, however, provided with conducting and non-conducting areas which interact directly with the switch contacts. This again gives rise to the above-mentioned sealing problem. Unlike the preceding solution, this does not provide for a different status pattern for the switches for each rotational position. Instead, starting from a small number of reference rotational positions, the status of a counter is raised or lowered depending on the direction of rotation. Only the reference rotational position is allocated a clearly designating status pattern in each case. The position is therefore determined relative to the reference rotational positions. If an error occurs during the rotational movement of the outer ring during the counting procedure, the status patterns of the switches of all subsequent rotational positions will be incorrectly interpreted. This transmission of the error is then only corrected when a reference rotational position is reselected since, as already mentioned, only this is allocated in each case to a clearly designated status pattern. For this reason there is insufficient guarantee of the operative reliability of this kind of solution.

CH 608 323 discloses a universal timepiece for twenty-four time zones having a dial divided into twelve. Cams are provided on the outer ring which in turn operate switches disposed in the timepiece casing. As in the preceding case, the status of counters changes when the outer ring is rotated relative to a reference position. Here, too, the problem of poor sealing and the transmission of errors arises. This specification also proposes permanent magnets and magnetic switches in place of cams and switches. It is, however, impossible to transfer the shown arrangement of cams and switches on a plurality of orbits lying close to one another to a magnetic solution since the distances between the permanent magnets and the magnetic switches would be far too small.

DE-OS 25 01 973 shows a solution which provides a single permanent magnet in the rotatable outer ring which causes switching of magnetic contacts located in the timepiece casing, one magnetic contact being provided for each defined rotational position. Stating from a large number of defined rotational positions an equally large number of magnetic contacts has to be provided, thereby necessitating substantially elevated material and assembly costs. This invention consequently does not provide a satisfactory solution for outer rings with a plurality of defined rotational positions.

CH 613 088 provides two permanent magnets in a disc located on the underside of the timepiece and two magnetic contacts in the casing of the timepiece which permit the detection of four different rotational positions. This document also fails to make any proposal for a larger number of rotational positions.

In order to permit economically priced manufacture and also long-term reliable operation, the object of the present invention lies in providing a universal timepiece with a device which makes it possible to reliably detect discrete rotational positions of an outer rotatable ring serving as manual input means which ensures an excellent seal of the inside of the timepiece and needs as few detection elements as possible.

The solution of this object according to the invention is set out in the features of claim 1.

The universal timepiece of the invention has the following advantages over the state of the art:

Because each defined rotational position of the outer ring is allocated its own status pattern of the magnetic switch, i.e. because each rotational position set can be detected independently of the preceding rotational positions, there is no transmission of any error that may occur in the electronic circuitry of the timepiece. The use of permanent magnets and magnetic switches rules out wear and tear, permitting excellent sealing. The use of five to eight magnetic switches for twenty-four discrete rotational positions keeps manufacturing costs very low.

The first embodiment according to claim 7 provides through the choice of eight magnetic switches and five permanent magnets for a relatively large distance between the permanent magnets in order to permit better breaking of the magnetic circuits individually produced by the permanent magnets in the interests of greater operational safety. In addition, the current consumption of the magnetic switches is low, since no more than two of these are used simultaneously in the switched on position. At least one magnetic switch is, however, switched on at each of the defined rotational positions, making it possible to detect any inadmissible intermediate positions.

According to a second embodiment of the universal timepiece of the invention according to claim 9, only five magnetic switches, but ten permanent magnets are provided. This solution is particularly interesting if the price of the magnetic switches is clearly higher than that of the permanent magnets. Because the five magnetic switches according to claim 10 are disposed side by side, only a small amount of space is needed, making it possible for example to keep the overall thickness of the watch small. In addition, the cost of effecting the electric connection between magnetic switches and clockwork movement can be kept low.

In general, the magnetic switches and the permanent magnets will hereinafter also be termed detection elements.

Figure 2:
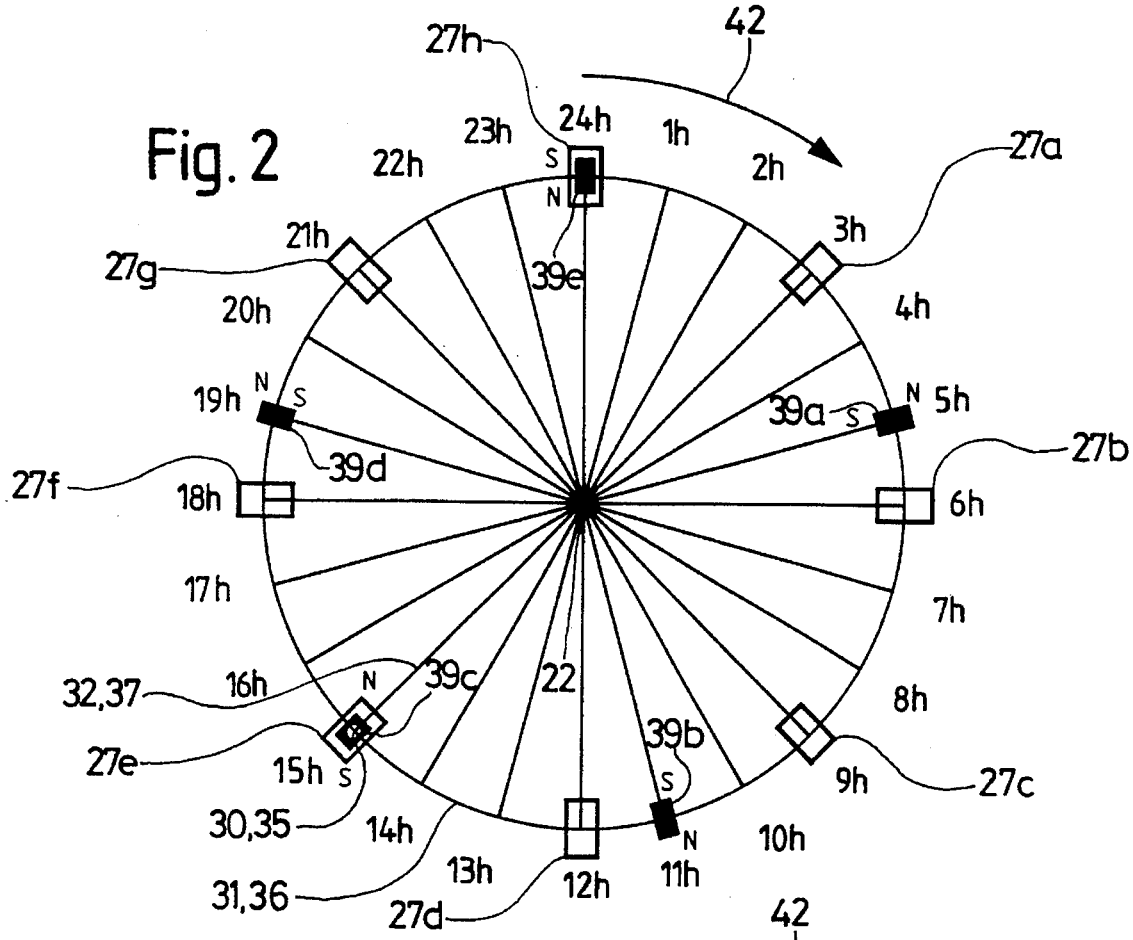
Figure 3:
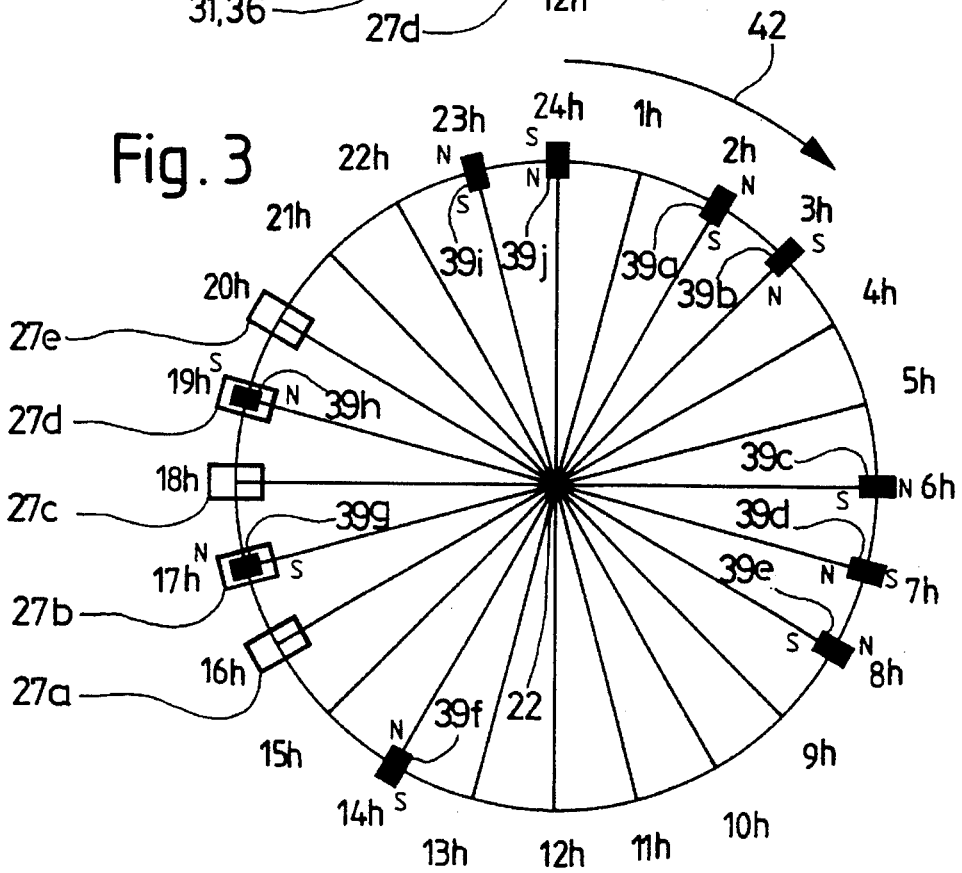

The invention will now be explained with respect to various embodiments, reference being made to the drawings. There are shown in:

FIG. 1 a partial section of the universal timepiece of the invention in spatial arrangement, FIG. 2 a diagrammatic arrangement of the detection elements according to a first embodiment of the universal timepiece of the invention, FIG. 3 a diagrammatic arrangement of the detection elements according to a second embodiment of the universal timepiece of the invention, FIG. 4 a logic table for FIG. 2, FIG. 5 a logic table for FIG. 3.

FIG. 1 shows a universal timepiece 10 of the invention having a central portion 11 with a floor 12 inserted in the underside and a glass 13 in the upper side. The central portion 11 forms a timepiece casing together with the floor 12. A seal 14 and 15 respectively is provided between the floor 12 and the central portion 11 as well as between the latter and the glass 13. The two seals 14 and 15 as well as the adjusting shaft and battery cover seals (not shown) enclose an interior space of the universal timepiece 10 designated 16 in watertight manner to the outside.

In the interior space 16 a dial 18 is anchored under the Glass 13 by means of a flange 17 and a movement 21 is disposed in the central portion 11 immediately above the floor 12 by means of securing stirrups 19 and screws 20. The movement 21 has an electronic circuit and stepping motors (not shown) to drive the hands (not shown). The purpose of the electronic circuit will be described hereinbelow. An axis of rotation designated 22 corresponds to the axis of the hands (not shown) which together with the dial 18 are termed the display device. A disc-shaped intermediate piece 23 is applied concentrically to the axis of rotation 22 on the upper side of the movement 21 with, lying thereon and projecting peripherally therefrom, a disc-shaped printed circuit 24.

FIG. 1 shows a small, hermetically sealed switch casing 25 which is inserted and bonded into a tooth-shaped groove 26 of the printed circuit 24 and bonded. The switch casing 25 completely occupies the Groove 26 and projects on the underside of the printed circuit 24 up to the movement 21. A magnetic switch 27*e* with an elongated fixed contact 28 and an elongated moveable contact 29 is located in the switch casing 25. Both contacts 28 and 29 are associated with the electronic circuit of the movement 21 by means of conductor paths (not shown) which run on both sides of the printed circuit 24.

The magnetic switch 27*e* is located in a first intersection 30 which emerges from a first circumferential line 31 and an associated first radius line 32 that runs about the axis of rotation 22. In the resting state, i.e. when not exposed to a magnetic field, the two elongated contacts 28 and 29 run substantially in the direction of this first radius line 32. However, since the magnetic switch 27*e* shown in FIG. 1 is exposed to a magnetic field, only the fixed contact 28 runs in this direction whereas the moveable contact 29 is bent.

Eight magnetic switches 27*a–h*, the position of which is described hereinbelow, are provided on the first circumferential line 31 according to FIG. 2. Outside the tightly closed interior space 16 a manually operable outer ring 33 in the shape of a world time ring is placed on the central portion 11 and rotatably fixed thereto by means of a securing ring 34. FIG. 1 does not show the listings of the most important twenty-four time zones, or their cities, provided on the upper side of the outer ring 33.

A recess 38 is disposed on the underside of the outer ring 33 in a second intersection 35 formed from a second circumferential line 36 concentric with the first of the same diameter and an associated second radius line 37. A permanent magnet 39*c* is inserted in this recess 38 and bonded with the outer ring 33. A permanent magnet 39*c* is positioned in such a manner that the radius line 37 runs through its two poles N and S, it not being necessary to consider its N-S poling for the present.

Permanent magnet 39*c* is advantageously located in the immediate proximity above magnetic switch 27*e*, i.e. a connecting line 40 connecting permanent magnet 39*c* with magnetic switch 27*e* and passing through the two intersections 30 and 35 runs parallel to the axis of rotation 22. A closed magnetic field 41 is shown between permanent magnet 39*c* and magnetic switch 27*e*.

In this embodiment, the universal timepiece 10 has eight magnetic switches 27*a–h* which are identical with magnetic switch 27*e* shown in FIG. 1 and also associated by means of conductor paths (not shown) with the electronic circuitry of the movement 21. By analogy thereto, permanent magnet 39*c* shown has been described as being representative for a total of five permanent magnets 39*a–e*. The arrangement of magnetic switches 27*a–h* and permanent magnets 39*a–e* is shown in FIGS. 2 and 3.

FIG. 2 shows diagrammatically a plan view of the universal timepiece 10 shown in FIG. 1 which only shows the detection elements. Each of the superimposed intersections 30 and 35, circumferential lines 31 and 36 and radius lines 32 and 37 are arranged in pairs. Twenty-four positions 1*h*–24*h* are defined on the circumferential line 31 and 36 at regular angular distances which correspond to the twenty-four hour marks (not shown) of the dial 18 and also correspond to the most important twenty-four hour time zones. The positions 1*h*–24*h* are thus immovably defined in relation to the casing 11, 12.

The eight magnetic switches 27*a–h* are disposed in the positions 3*h*, 6*h*, 9*h*, 12*h*, 15*h*, 18*h*, 21*h* and 24*h*, whereas the five permanent magnets 39*a–e* for the rotational position of the outer ring 33 shown herein are located in the positions which correspond to the hour marks 5*h*, 11*h*, 15*h*, 19*h* and 24*h*. Since the contacts 28 and 29 of magnetic switches 27*a–h* only close when in each case a permanent magnet 39*a–e* is present above them, i.e. in the same position, only the two magnetic switches 27*e* and 27*h* are closed in the rotational position shown, whereas the remaining six magnetic switches 27*a–d* and 27*f–g* remain open.

The position of permanent magnets 39*a–e* shifts when the outer ring 33 is rotated in the direction of the arrow 42 by one angle unit of 15°, specifically permanent magnet 39*a* moves from the 5*h* position to 6*h*, 39*b* from 11*h* to 12*h*, 39*c* from 15*h* to 16*h*, 39*d* from 19*h* to 20*h* and 39*e* from 24*h* to 1*h*. This also closes magnetic switches 27*b* and 27*d* while magnetic switches 27*e* and 27*h* open.

Assuming that the statuses of the eight magnetic switches 27*a–h* are summarised into an 8-bit status pattern, an intrinsic, unique status pattern is formed in each case for each of the twenty-four rotational positions provided for the outer ring 33. There is therefore a clear and objective relationship between each of the twenty-four discrete rotational positions of the outer ring 33 and its status pattern in each case.

FIG. 4 shows a logic table in which the status pattern for the arrangement of the eight magnetic switches 27*a–h* and the five permanent magnets 39*a–e* shown in FIG. 2 are shown for all twenty-four rotational positions of the outer ring 33. This starts from the position of the outer ring 33 designated 0° in FIG. 2, the outer ring 33 being turned in 15° steps in the direction of the arrow.

This table shows that there exists in each case an intrinsic, clearly identifiable status pattern for each of the twenty-four rotational positions of the outer ring 33. This means that each rotational position can be detected by the electronic circuit of the movement 21 independent of the preceding one(s).

This solution also has the following advantage: Since permanent magnets 39*a–e* are at least four rotational positions from one another, i.e. are at least 60° apart, the magnetic fields 41 generated by them are virtually completely separated from one another. In the alternative case of two directly adjacent permanent magnets, there may under certain circumstances be an undesired effect on not directly superimposed, but neighbouring magnetic switches.

This influence also depends on the magnetic orientation of the permanent magnets, i.e. on whether they are directed in the same or opposite orientations. For this reason, this solution aims at also placing magnetic switches 27*a–h* as far as possible from one another, by three rotational positions in each case, i.e. by 45°. This distribution of magnetic switches 27*a–h* and permanent magnets 39*a–e* ensures the greatest possible operational safety without it being necessary to consider the N-S orientation when inserting permanent magnets 39*a–e* into the recesses 38.

On the one hand, according to FIG. 4 only a maximum of two of magnetic switches 27*a–h* are in the switched on state, which as already mentioned is able to reduce the current consumed by the electronic circuit of the movement 10 down, on the other hand, at least one is switched on to detect inadmissible intermediate positions of the outer ring 33. In the case of the angular distance of 45° for magnetic switches 27*a–h* and for a minimum angular distance of 60° for permanent magnets 39*a–e* there is no solution with a smaller number of detection elements although there are still numerous other equivalent ways of distributing permanent magnets 39*a–e* among the twenty-four positions. New possibilities also arise when, for example, the minimum distance of magnetic switches 27*a–h* and permanent magnets 39*a–e* are re-defined. A very interesting extreme case is described hereinafter in FIG. 3:

FIG. 3 shows a representation in the sense of FIG. 2, but with a different number and distribution of the magnetic switches and permanent magnets. Here, only five magnetic switches are provided which are identical to magnetic switches 27*a–h* of FIG. 2 and therefore designated 27*a–e*. On the other hand, at least ten, but a maximum of fourteen permanent magnets 39*a–j* are, however, needed to be able to generate twenty-four different status patterns at magnetic switches 27*a–e*. Magnetic switches 39*a–j* are also identical with those 39*a–e* of FIG. 2. The five magnetic switches 27*a–e* are provided in the positions 16*h*–20*h*, whereas the ten magnetic switches 39*a–j* are distributed amongst the positions 2*h*, 3*h*, 6*h*–8*h*, 14*h*, 17*h*, 19*h* and 23–24*h*.

Permanent magnets 39*a–j* lying immediately adjacent one another, i.e. the permanent magnets of the two twin groups 39*a–b* and 39*i–j* as well as those of the triple group 39*c–e* should advantageously have opposite polarity. This means that, for example, permanent magnets 39*c* and 39*e* are oriented according to FIG. 1 whereas the interpolated permanent magnet 39*d* is opposite, i.e. directed with the N-pole facing axis of rotation 22. Since this makes the strengths of each of the magnetic fields between permanent magnets 39*c–e* minimal, the magnetic switch lying thereunder is off for a short time when the outer ring 33 is rotated between the two correspondingly defined rotational positions.

The same applies to not immediately adjacent permanent magnets. For example, were permanent magnets 39*a* and 39*j* both oriented in the same way, as shown in FIG. 1, a sufficiently strong magnetic field could develop therebetween, i.e. in the 1*h* position, so as to cause a magnetic switch located directly thereunder to switch. Here, too, an opposing poling of the two magnetic switches 39*a* and 39*j* should preferably be chosen.

Should in the first embodiment of the universal timepiece of the invention according to FIG. 2 still have an undesired influence on magnetic switches 27*a* to 27*d*, 27*f* and 27*g* not located directly thereunder, despite the relatively large angle distance of at least 60° between in each case two permanent magnets 39*a* and 39*b*, 39*b* and 39*c*, etc., that are either adjacent one another or adjacent the circumferential line 36, it may also be appropriate in this case, as already stated in connection with the solution shown in FIG. 3, to provide for an alternating orientation of permanent magnets 39*a–e*. Permanent magnets 39*b*, 39*d* and 39*a* should, for example, be directed according to the permanent magnets shown in FIG. 1, i.e. with the south pole facing axis of rotation 22, whereas the south pole of the two permanent magnets 39*c* and 39*e* face away from the axis of rotation 22, as shown in FIG. 2.

It is, however, shown in FIG. 2 that a point arises for uneven numbers of permanent magnets, here 39*a–e*, at which the alternating orientation is no longer possible, i.e. that a pair of permanent magnets adjacent the circumferential line 36, here 39*a* and 39*b*, must display the same orientation. The problem of neighbouring magnetic switches perhaps being influenced by a possibly sufficiently strong magnetic field of the interposed positions, here 6*h* to 9*h*, that may arise in this case may be overcome by disposing these two similarly oriented permanent magnets 39*a* and 39*b* in a relatively broad angle distance.

In practical terms, this means for the example shown in FIG. 2, at which angular distances of 90° exist between permanent magnets 39*a* and 39*b*, of 60° between 39*b* and 39*c* as well as 39*c* and 39*d*, of 75° between 39*d* and 39*e* as well as 39*e* and 39*a*, allocating the same orientation to the two permanent magnets 39*a* and 39*b* since the largest angle distance, namely 90° exists between these.

The decision as to which pair of permanent magnets can be similarly directed must in each case be adjusted to the structural features of the timepiece.

If a structural solution has been selected for the timepiece which in each case adequately screens the magnetic field emanating from a permanent magnet tangentially to the circumferential line designated 36 in FIG. 2, with the result that each permanent magnet only directly influences magnetic switches 27*e* and 27*b* located thereunder, it is possible in such cases, as mentioned, to disregard the orientation of the permanent magnets 39*a–e*. However, should the structural design of the timepiece effect a quasi-cross reaction, i.e. an influence on magnetic switches not located directly underneath the permanent magnets, it is basically advantageous to adopt a sequentially alternating direction of permanent magnets 39*a–e* where possible.

To avoid misunderstandings it is, for example, noted that according to the rotational position of the outer ring 33 shown in FIG. 2, magnetic switches 27*a* to 27*d*, 27*f* and 27*g* are not located directly under one of permanent magnets 39*a–e*, but could possibly nonetheless be able to switch because of diagonally superimposed permanent magnets 39*a–e*. Unintentional switching of this type can, as stated, be prevented with alternating poling of permanent magnets 39*a–e*.

An alternating orientation of the permanent magnets along the circumferential line of the timepiece thus effectively reduces or totally prevents any harmful influences of the permanent magnets on those magnetic switches that are not located in their allocated rotational positions. It is possible to resort to this positive effect, in particular in the case of a high density of permanent magnets, without being fundamentally limited to the number of permanent magnets and magnetic switches.

By analogy with the logic table of FIG. 4, FIG. 5 shows for the solution shown in FIG. 2 that a clearly characterising status pattern also exists in each case for each of the twenty-four rotational positions of the outer ring 33.

The number of five magnetic switches 27*a–e* proposed according to FIG. 3 corresponds to the absolute minimum for twenty-four rotational positions. The small number of magnetic switches 27*a–e* has a favourable effect on manufacturing costs, since their price is generally markedly higher than that of permanent magnets. Since the five magnetic switches 27*a–e* are located directly adjacent one another, the cost of wiring can be reduced, with additional favourable consequences for the manufacturing costs.

All the hitherto shown examples are based on a given conventional movement 21, which explains why the disc-shaped intermediate piece 23 and the disc-shaped printed circuit 24 are provided to take up magnetic switches 27*a–h* and 27*a–e* respectively. Assuming that the movement 21 has for example space on its periphery to accommodate the five adjacent magnetic switches 27*a–e*, the intermediate piece 23 and the printed circuit 24 can be dispensed with. This leads to lower costs and it is possible to aim for a smaller thickness for the universal timepiece 10.

It is also possible to provide recesses in the movement 21 itself to accommodate magnetic switches 27*a–h* and 27*a–e* respectively, either for an arrangement according to FIG. 2 or according to FIG. 3.

The mode of operation of the above-described universal timepiece 10 according to FIGS. 1 to 3 is as follows:

The user moves the appropriate time zone or city into position 24*h* (FIGS. 2 or 3) by turning the outer ring 33 while the display device continues to display the same local time as before this manipulation. The display device only takes over the local time in the time zone selected after briefly depressing the crown. In so doing, the electronic circuit, which advantageously contains a microprocessor, reads the status pattern of magnetic switches 27*a–h* and 27*a–e* respectively, looks for this pattern in a stored table, reads the associated, new desired position of the hands and corrects the position of the hands accordingly. Since the status of magnetic switches 27*a–h* and 27*a–e* respectively can in this case only be called up on command for a short space of time, there is no need for it to be permanently stored. Electrical energy is saved since the magnetic switch is only under potential when the crown is depressed.

It is also possible that the universal timepiece 10 continuously follows manipulations to the outer ring 33, i.e. that the direction of display continuously takes over the local time of the time zone selected from the electronic circuit without it being necessary to wait for an acknowledgement, as in the previously described case.

According to another advantageous solution, the local time displayed initially changes immediately with each change in the position of the outer ring 33. Once the outer ring 33 has not been readjusted, for example, for ten seconds, the display device returns to the local time originally displayed, independent of the rotational position of the outer ring 33 now set. When the crown is pressed, the display device in any case takes over the local time of the time zone selected at this moment in time. This solution is predominantly intended for users who rarely leave their own time zone, but who often need to know the local time in other time zones, for example in order to be able to choose the appropriate time to make telephone calls.

Since the electronic circuit is not an object of the invention no description is provided thereof. As is generally known, there exist a vast number of possibilities here. It is, for example, possible to dispense with a microprocessor completely if, for example, the steps to be carried out by the hands driven by the stepping motor originate directly from the electronic circuit, the state of which is defined by magnetic switches 27*a–h* and 27 *a–e* respectively.

It is, of course, possible to arrange the acknowledgement in a different manner, e.g. by pulling the crown or by means of an additional push button.

It can be basically interesting to provide one or a plurality of additional magnetic switches as a redundancy check. Information from the additional magnetic switch(es) makes it possible to establish or even to correct any possible reading error. This makes it possible, for example, to determine the failure of a magnetic switch and to draw the attention of the wearer of the timepiece thereto. Alternatively, the incorrect status pattern of the magnetic switch is interpreted as a different rotational position of the outer ring 33 and the universal timepiece 10 displays an incorrect local time.

Because the proposed orientation of the N-S axis of the permanent magnets is orthogonal to the axis of rotation 22, only minor magnetic fields 41 escape the timepiece.

It is fundamentally possible to use Hall probes instead of magnetic switches.

In place of the magnetic switches and permanent magnets it is, however, also possible to provide non-contact proximity sensors or light barriers with, for example, reflection mirrors provided in the outer ring 33.

The design of a universal timepiece according to the invention permits the reliable detection of the discrete rotational positions of the outer ring for a long period of time at low manufacturing costs, without it being necessary to allow for a tendency to the accumulation of errors arising in the electronic circuit. This solution also offers optimum prerequisites with regard to casing sealing.

What is claimed is:

1. A universal timepiece having a movement, at least one display means, a timepiece casing, at least one outer ring serving as a manually operable input means which is rotatable about an axis of rotation in relation to the timepiece casing and which is adapted to assume a plurality of pre-defined rotational positions and having a device for detecting the manually adjustable rotational positions of the outer ring, where this device has a plurality of elements of a first type arranged substantially along a first circumferential line extending about the axis of rotation and secured within the timepiece casing, and a plurality of elements of a second type, arranged substantially along a second circumferential line extending about the rotational axis concentric to the first and secured within the input means, whereby the elements of the second type move the elements of the first type into pre-defined binary states whereby the totality of these binary states is different for each defined rotational position of the input means, wherein the outer ring can be placed in any of twenty-four defined rotational positions each with a time zone allocated thereto, that from five to eight elements of the first type are provided and their states are determined in non-contact manner by the elements of the second type.

2. A universal timepiece according to claim 1, wherein the elements of the second type are in the form of permanent magnets.

3. A universal timepiece according to claim 2, wherein the elements of the second type are in the form of magnetic switches.

4. A universal timepiece according to claim 1, wherein a further manually operable input means is provided which initiates the takeover of the time of the time zone selected using the outer ring to the display means.

5. A universal timepiece according to claim 4, characterised in that a crown is provided as additional input means.

6. A universal timepiece according to claim 4, characterised in that a push button is provided as additional input means.

7. A universal timepiece according to claim 1, wherein eight magnetic switches are provided as elements of the first type and five permanent magnets are provided as elements of the second type.

8. A universal timepiece according to claim 1, wherein that five magnetic switches are provided as elements of the first type and ten to fourteen permanent magnets are provided as elements of the second type.

9. A universal timepiece according to claim 8, characterised in that ten permanent magnets are provided.

10. A universal timepiece according to claim 8, characterised in that the magnetic switches are disposed adjacent each other.

* * * * *